US008987591B2

(12) United States Patent
Nordin et al.

(10) Patent No.: US 8,987,591 B2
(45) Date of Patent: Mar. 24, 2015

(54) COMMUNICATION CHANNELS WITH CROSSTALK-MITIGATING MATERIAL

(75) Inventors: Ronald A. Nordin, Naperville, IL (US); Masud Bolouri-Saransar, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 969 days.

(21) Appl. No.: 12/663,037

(22) PCT Filed: Jun. 11, 2008

(86) PCT No.: PCT/US2008/066562

§ 371 (c)(1), (2), (4) Date: Apr. 12, 2010

(87) PCT Pub. No.: WO2008/157175

PCT Pub. Date: Dec. 24, 2008

(65) Prior Publication Data

US 2010/0206608 A1 Aug. 19, 2010

Related U.S. Application Data

(60) Provisional application No. 60/943,439, filed on Jun. 12, 2007.

(51) Int. Cl.
*H01B 11/06* (2006.01)
*H01B 11/10* (2006.01)

(52) U.S. Cl.
CPC ..... *H01B 11/1008* (2013.01)
USPC ..... 174/36; 174/113 R

(58) Field of Classification Search
USPC ..... 174/36, 113 R, 106 R, 117 A
See application file for complete search history.

(56) References Cited

U.S. PATENT DOCUMENTS

| | | | | | |
|---|---|---|---|---|---|
| 3,927,247 | A | * | 12/1975 | Timmons | 174/36 |
| 4,746,767 | A | * | 5/1988 | Gruhn | 174/36 |
| 5,037,999 | A | | 8/1991 | VanDeusen | |
| 5,956,445 | A | * | 9/1999 | Deitz et al. | 385/100 |
| 6,064,000 | A | * | 5/2000 | Kim | 174/36 |
| 6,246,006 | B1 | * | 6/2001 | Hardin et al. | 174/106 R |
| 7,737,362 | B2 | * | 6/2010 | Ogura | 174/102 R |
| 8,217,267 | B2 | * | 7/2012 | Nordin et al. | 174/102 R |
| 2006/0048961 | A1 | | 3/2006 | Pfeiler et al. | |
| 2007/0037419 | A1 | | 2/2007 | Sparrowhawk | |

FOREIGN PATENT DOCUMENTS

| | | | |
|---|---|---|---|
| GB | 2432963 | * | 6/2007 |
| GB | 2432963 A | | 6/2007 |
| JP | 2004-259599 | * | 9/2004 |
| JP | 2006-173044 | * | 6/2006 |

* cited by examiner

*Primary Examiner* — Chau N Nguyen
(74) *Attorney, Agent, or Firm* — Christopher S. Clancy; Yuri Astvatsaturov

(57) ABSTRACT

Alien crosstalk in communication channels is decreased with the use of crosstalk-mitigating materials. Electrical communication cables may be provided with crosstalk-mitigating materials that surround twisted pairs in the cables. According to one embodiment, the crosstalk-mitigating material is an electrically resistive material having electrically conductive areas placed thereon. Such a material mitigates the effects of electrical and magnetic fields that would normally lead to alien crosstalk between communication channels.

21 Claims, 4 Drawing Sheets

COMMUNICATION CHANNELS WITH CROSSTALK-MITIGATING MATERIAL

FIELD OF THE INVENTION

The present invention is generally directed to communication cables and more specifically directed to communication cables having layers of crosstalk-mitigating materials.

BACKGROUND OF THE INVENTION

Communication cables comprised of multiple twisted pairs of conductors are common, with four-pair cables being widely used. In high-speed data networks, crosstalk can result within communication cables and between nearby communication cables. Crosstalk occurring within a cable includes near-end crosstalk (NEXT) and far-end crosstalk (FEXT), and alien crosstalk occurring between cables includes alien near-end crosstalk (ANEXT) and alien far-end crosstalk (AFEXT). Suppression of alien crosstalk in communication channels is important, because alien crosstalk can reduce the signal-to-noise ratio in a communication channel and increase the channel's bit error rate. As communication bandwidth increases, the reduction of noise such as alien crosstalk in communication cables becomes increasingly important.

In high-bandwidth communication applications, communication cables are commonly installed alongside one another, and ANEXT and AFEXT can result between adjacent or nearby communication cables. ANEXT and AFEXT become more problematic at frequencies above 10 MHz, and ANEXT and AFEXT noise at high frequencies are present in high-speed data transmission systems such as 10 Gigabit Ethernet signaling.

Alien crosstalk includes the following:

1. Differential mode crosstalk produced by differential signals propagating in a twisted pair in one cable coupling to another twisted pair in another cable;

2. Common mode crosstalk produced by common mode signals propagating in one cable or external sources coupling to all wires in another cable. This coupled common mode signal can then convert to differential mode alien crosstalk. The conversion is typically produced by a wire pair imbalance or a connecting hardware imbalance.

3. Differential mode crosstalk produced by a differential signal propagating between two twisted pairs in one cable coupling to the wires in another cable either differentially or in common mode. This differential signal propagating via two twisted pairs in a cable is also called a "super pair mode," which can be produced in connecting hardware due to a "split pair" (wires 3 and 6) coupling to wire pairs 1-2 and 7-8 forming a "super" twisted pair.

ANEXT and AFEXT arise due to electrical and magnetic couplings between conductors in different cables. The magnitude of ANEXT in twisted pair systems is proportional to the difference between the magnitude of the electrical coupling and the magnitude of the magnetic coupling (in the following formulas, "C" refers to coupling):

$$|\text{ANEXT}|=|C_{(electric)}-C_{(magnetic)}|.$$

In order to decrease ANEXT, the electrical and magnetic couplings can both be decreased. For example, assume that the $C_{(electric)}$=Ce=0.25 and $C_{(magnetic)}$=Cm=0.15, then the difference, Cd=0.1. If both couplings are reduced by an order of magnitude, then Ce=0.025 and Cm=0.015 and the difference would be Cd=0.01. NEXT can also be reduced by reducing the coupling giving rise to the larger of the two magnitudes. For example, again assuming that Ce=0.25 and Cm=0.15 corresponding to a Cd=0.1. If Ce is reduced by 20% or Ce=0.2 then Cd will be reduced to Cd=0.05.

AFEXT in twisted pair systems is found by determining the sum of the electrical coupling and the magnetic coupling:

$$|\text{AFEXT}|=|C_{(electric)}+C_{(magnetic)}|.$$

In order to decrease AFEXT, either or both of the electrical coupling and the magnetic coupling should be reduced.

It is desirable to reduce alien crosstalk. It is particularly desirable to achieve this reduction in a way that addresses the electrical and magnetic couplings that give rise to alien crosstalk.

SUMMARY OF THE INVENTION

Improved communication cables are provided with a layer of crosstalk-mitigating material having discrete conductive areas.

According to one embodiment of the present invention, a cable core comprising four twisted pairs of conductors is surrounded with a layer of crosstalk-mitigating material having discrete conductive areas.

According to some embodiments of the present invention, the layer of crosstalk-mitigating material having discrete conductive areas comprises a semiconductive foil having discrete conductive areas placed thereon.

According to some embodiments of the present invention, the layer of crosstalk-mitigating material having discrete conductive areas comprises a highly electrically resistive layer having discrete conductive areas placed thereon.

According to some embodiments of the present invention, a crosstalk-mitigating material comprises a thin resistive layer of metal.

According to another embodiment of the present invention, a crosstalk-mitigating material comprises a thin resistive layer of metal having discrete conductive areas placed thereon.

According to different embodiments of the present invention, crosstalk-mitigating materials are used to surround: (a) an entire cable core; (b) each of the twisted pairs within the cable; or (c) a subset of twisted pairs within the cable. According to some embodiments of the present invention, crosstalk-mitigating material surrounds both the entire cable core and either each of the twisted pairs within the cable, or a subset of twisted pairs within the cable.

DETAILED DESCRIPTION OF THE ILLUSTRATED EMBODIMENTS

ANEXT and AFEXT can result from unbalanced coupling from conductive pairs in one cable to another cable or from balanced couplings that get converted to differential signals within the cabling.

Figure 1:
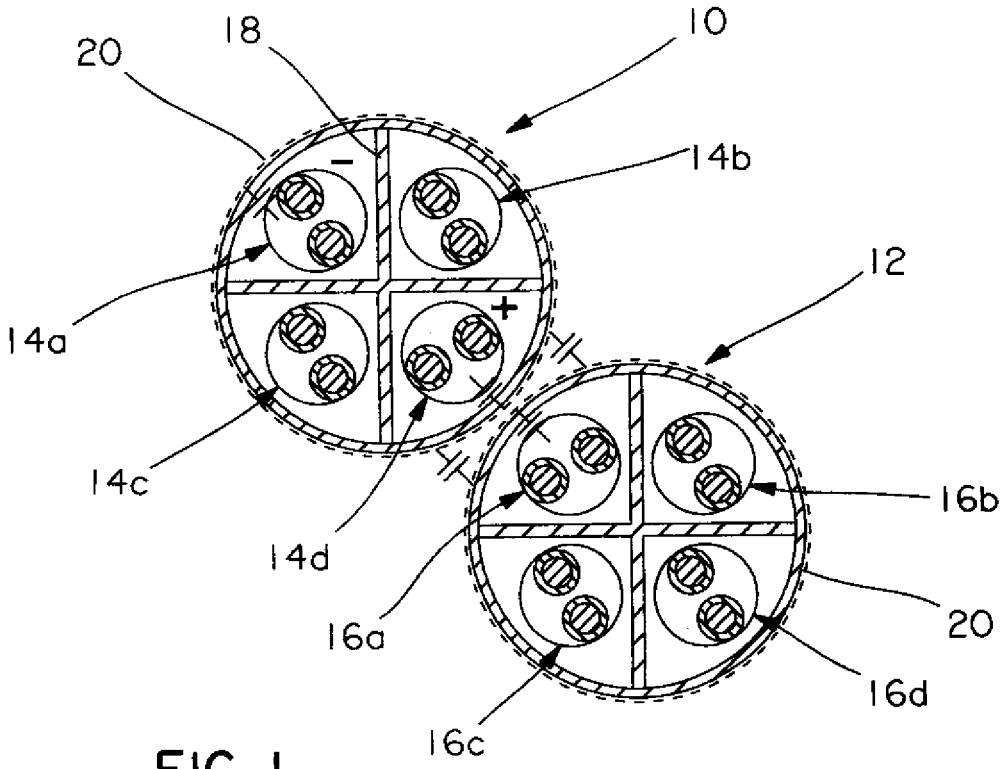
FIG. 1 is a cross-sectional view showing two adjacent communication cables according to the present invention.

The present invention is directed to a cable construction that reduces ANEXT and AFEXT between adjacent cables by addressing the electrical and magnetic interactions that give rise to ANEXT and AFEXT. FIG. 1 is a cross-sectional view of first and second cables 10 and 12 according to one embodiment of the present invention. The first cable 10 has four twisted wire pairs 14*a*, 14*b*, 14*c*, and 14*d*. The second cable has four twisted wire pairs 16*a*, 16*b*, 16*c*, and 16*d*. In the embodiment shown, the twisted pairs of each cable are separated by a crossweb 18. It is to be understood that in other embodiments of the present invention, other types of separators—or no separator at all—may be employed.

Figure 2:
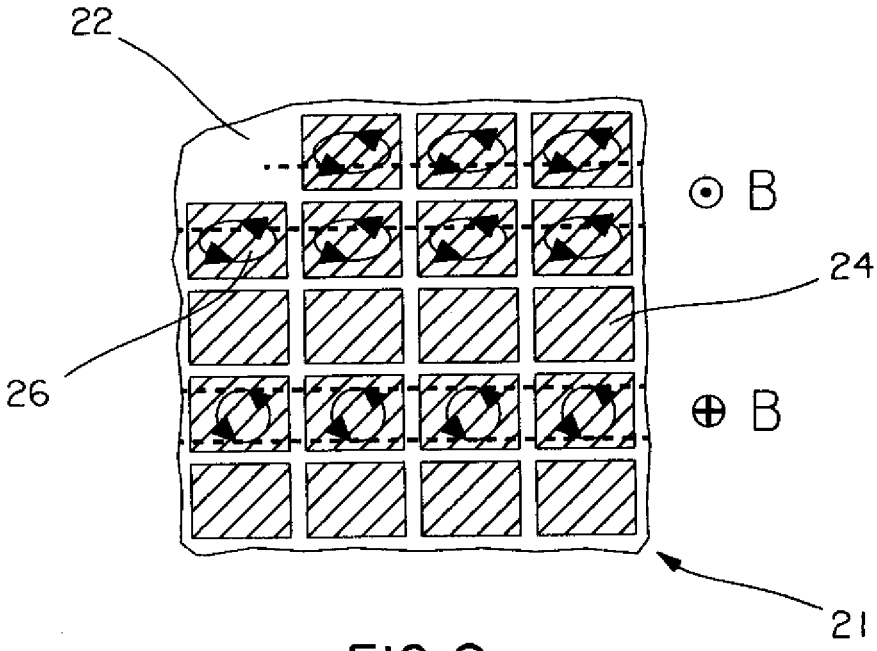
FIG. 2 is a plan view of a crosstalk-mitigating material having discrete conductive areas according to one embodiment of the present invention.

The twisted pairs in each cable 10 and 12 comprise cable cores, and are surrounded by a layer 20 of a crosstalk-mitigating material. The layer 20 of crosstalk-mitigating material may be placed inside of the cable jacket (not shown). One embodiment of a crosstalk-mitigating material 21 according to the present invention is shown in FIG. 2. In the embodiment of FIG. 2, the crosstalk-mitigating material 21 consists of a substrate 22 having conductive areas 24 overlaid thereon.

According to one embodiment of the present invention, the substrate 22 is made of a highly electrically resistive material such as a plastic, and the conductive areas 24 are made of a highly electrically conductive material. This combination of materials primarily reduces magnetic coupling that gives rise to alien crosstalk, but also to a lesser extent reduces capacitive coupling. The crosstalk-mitigating material 21 has beneficial effects on the magnetic coupling because of the loss due to eddy currents 26 (as shown in FIG. 2) formed within the conductive areas 24 by the magnetic fields B of the twisted wire pairs. The conductivity of the material used in the conductive areas 24 can determine the level of the reduction in magnetic coupling.

Figure 3:
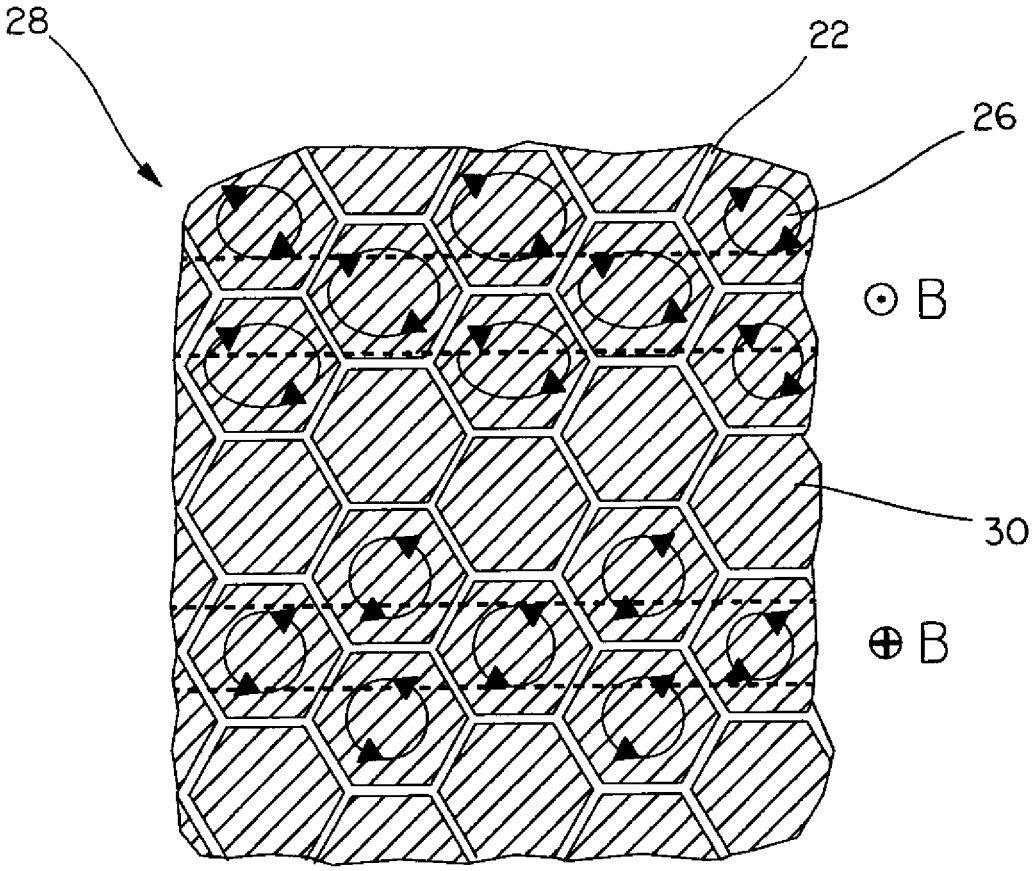
FIG. 3 is a plan view of a crosstalk-mitigating material having discrete conductive areas according to another embodiment of the present invention.

Crosstalk-mitigating materials similar to the crosstalk-mitigating material 21 shown in FIG. 2 can be made using a variety of different dimensions and shapes for the conductive areas. For example, according to one embodiment of the present invention, conductive areas may be 0.2 inch×0.3 inch rectangles, with 0.005 inches between rectangles. According to other embodiments of the present invention, the conductive areas may be made of different shapes such as regular or irregular polygons, other irregular shapes, curved closed shapes, isolated regions formed by conductive material cracks, and/or combinations of the above. FIG. 3 shows an alternative crosstalk-mitigating material 28 in which a substrate 22 is overlaid with hexagonal conductive areas 30. Similarly to the crosstalk-mitigating material 21, the hexagonal conductive areas 30 result in eddy currents 26 when acted upon by a magnetic field B.

In the embodiments of FIGS. 2 and 3, the material for the conductive areas 24 and 30 may be selected from a range of metals, including such metals as copper, aluminum, and silver. The material for the substrate 22, and for other substrates according to other embodiments, may be a plastic. Examples of plastics according to some embodiments include polyimide, polyester, polypropylene, polyethylene, PVC (polyvinyl chloride), PTFE (polytrifluoroethylene), and foamed variances of these materials. The thicknesses of the conductive areas 24 and 30 may range from about 0.2 μm to about 0.8 μm. The thickness of the substrate 22 may range from about 0.5 mils to about 15 mils. Other thicknesses for both the conductive areas 24 and the substrate 22 may be selected based on desired physical and electromagnetic characteristics for particular implementations. According to some embodiments, the materials and thickness of the conductive areas 24 may be chosen to provide a sheet resistance ranging from about 1 mΩ/sq. to about 10 mΩ/sq.

Figure 4:
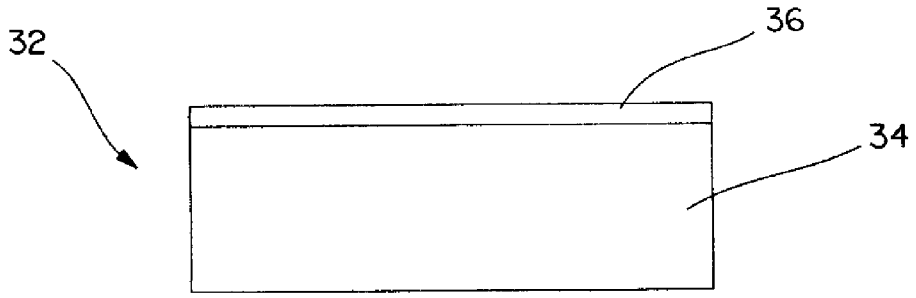
FIG. 4 is a cross-sectional side view of a segment of crosstalk-mitigating material according to another embodiment of the present invention.

Other types of crosstalk-mitigating material may be used in different embodiments of the present invention. FIG. 4 is a cross-sectional view of a segment of a crosstalk-mitigating material 32 comprising a dielectric layer 34 and a thin metal layer 36. Similarly to the crosstalk-mitigating material 21, described above, the dielectric layer may comprise a plastic. The thin metal layer 36 may comprise a metal such as aluminum, copper, silver, chromium, or other metals. According to some embodiments, the thin metal layer 36 has a thickness of between about 1 nm and about 5 nm. The thickness of the dielectric layer 34 may be between about 1 mil and about 15 mils, with thicknesses from about 10 mils to about 15 mils being useful in some embodiments. Other thicknesses for both the thin metal layer 36 and the dielectric layer 34 may be selected based on desired physical and electromagnetic characteristics for particular implementations. The materials and thickness of the thin metal layer 36 may be chosen to provide a sheet resistance ranging from about 1 kΩ/sq. to about 20 kΩ/sq.

The twisted pairs of a cable assembly couple both magnetically and electrically (i.e., capacitively) to neighboring cable assemblies via the resistive cross-talk mitigating material surrounding each of the cable assemblies. FIG. 1 illustrates an electrical effect of a crosstalk-mitigating layer 20 using capacitive indicators to show capacitive coupling. The embodiment of FIG. 1 will now be described, in which the layer 20 is the crosstalk-mitigating material 32 of FIG. 4. Since the sheet resistance of the crosstalk-mitigating material 32 is large, the magnetic coupling between the cables will be minimally affected. However, the electrical capacitive coupling between the cables will be reduced. This reduction occurs due the charge buildup on the resistive material 32 due to the electric field resulting from the twisted pairs. This induced charge is distributed longitudinally along the length of the cable assembly due to the propagating electromagnetic waves within the twisted pairs. This induced charge also moves according to the charge difference that occurs longitudinally along the crosstalk mitigating material along the cable as well as around its circumference. As this induced charge re-distributes itself, its charge density is reduced which reduces the capacitive coupling between the cables 10 and 12. The crosstalk-mitigating material 32 primarily reduces the capacitive (or "electrical") coupling, but also to a lesser extent reduces the magnetic coupling between twisted pairs in different cables. Additionally, the crosstalk-mitigating material 32 increases the attenuation of the signal that is propagating within the cable containing the "super pair."

Figure 5:
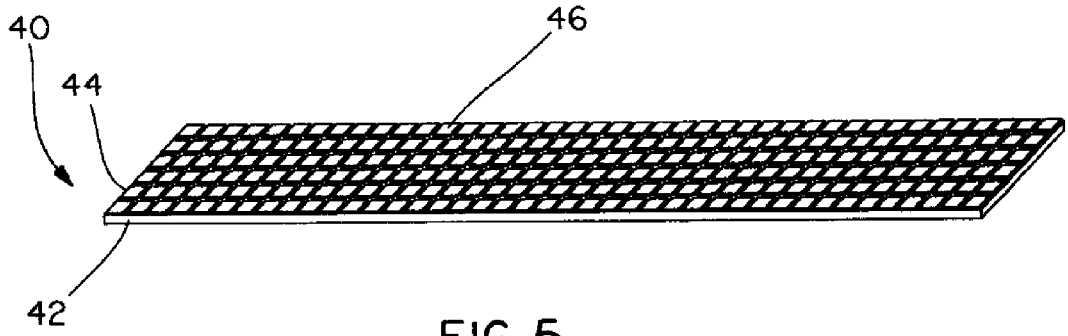
FIG. 5 is a perspective view of a crosstalk-mitigating material according to one embodiment of the present invention.

FIG. 5 is a perspective view of a segment of crosstalk-mitigating material 40 according to another embodiment of the present invention. The crosstalk-mitigating material 40 comprises a substrate 42, a thin metal layer 44, and conductive areas 46. The substrate 42 is overlain with the thin metal layer 44, and the conductive areas 46 are placed atop the thin metal layer 44. As with other embodiments of crosstalk-mitigating materials according to the present invention, the crosstalk-mitigating material 40 is designed to be wrapped around: (a) a cable core comprising a plurality of twisted wire pairs; (b) one or more twisted wire pairs within a cable core; or (c) both a cable core and one or more twisted pairs within the core. According to some embodiments, the conductive areas 46 may comprise a metal selected from a variety of metals such as aluminum, copper, and silver. The thin metal layer 44 may comprise a metal selected from a variety of metals such as aluminum, copper, silver, and chromium. In other embodiments, different metals or combinations of metals may be selected for the thin metal layer 44 and the conductive areas 46. Similarly to the embodiments of FIGS. 2 and 3, above, the conductive areas 46 may be sized and shaped in a variety of ways in order to achieve particular structural, electrical, and magnetic characteristics.

Figure 6:
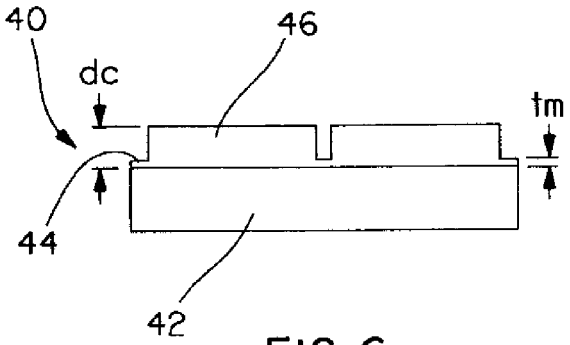
FIG. 6 is a cross-sectional side view of a segment of crosstalk-mitigating material according to one embodiment of the present invention.

FIG. 6 is a cross-sectional view of a segment of the crosstalk-mitigating material 40, showing the substrate 42, the thin metal layer 44, and the conductive areas 46. The thin metal layer 44 has a thickness, $t_m$ of from about 1 nm to about 5 nm. The conductive areas 46 have a total depth, $d_c$, from about 0.2 μm to about 0.8 μm.

Figure 7:
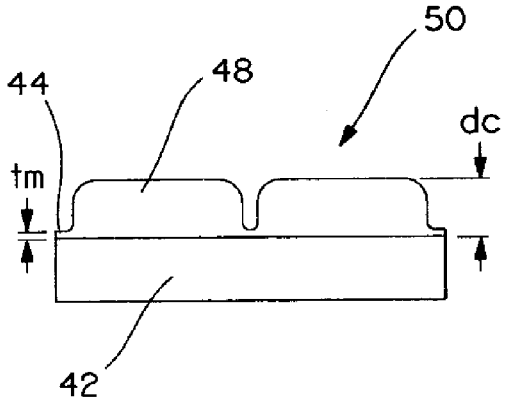
FIG. 7 is a cross-sectional side view of a segment of crosstalk-mitigating material according to another embodiment of the present invention.

FIG. 7 is a cross-sectional view of a segment of crosstalk-mitigating material 50. The specifications of the crosstalk-mitigating material 50 are similar to those of crosstalk-mitigating material 40 of FIG. 6, except that the conductive areas 48 have rounded corners.

In some embodiments of the present invention, if foil-shielded twisted pairs are being implemented, and if a thin substrate is used for a crosstalk-mitigating material, a "substrate-metal layer-substrate" construction should be used for the crosstalk-mitigating material in order to keep the crosstalk-mitigating material away from the twisted pairs. If foil-shielded twisted pairs are being implemented, and if a thicker substrate is used for the crosstalk-mitigating material, a "metal layer-substrate" construction should be used in which the metal layer of the crosstalk-mitigating material is farther than the substrate layer from the twisted pairs.

Figure 8:
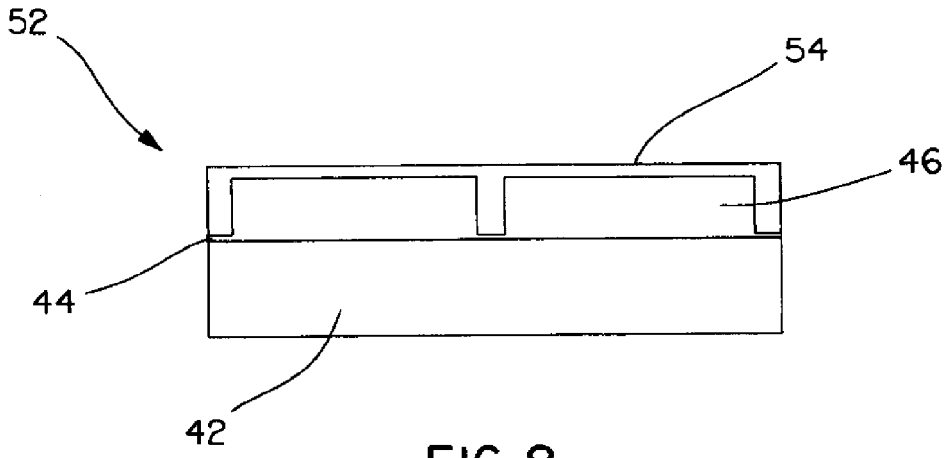
FIG. 8 is a cross-sectional side view of a segment of crosstalk-mitigating material having a protective layer.

FIG. 8 is a cross-sectional view of a crosstalk-mitigating material 52 in which a protective covering 54 is used to prevent the metal surfaces from corroding or oxidizing. Techniques for providing the protective covering 54 may include tin or silver plating of the top surface, or placing a plastic film on top of the metal.

Figure 9:
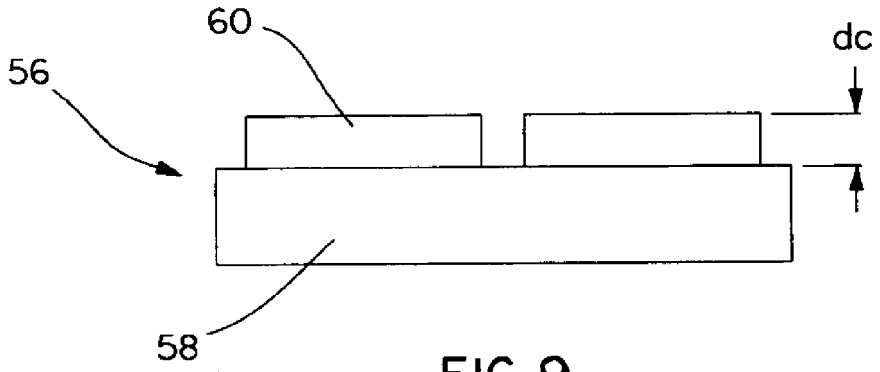
FIG. 9 is a cross-sectional side view of a segment of crosstalk-mitigating material according to another embodiment of the present invention.

FIG. 9 shows a crosstalk-mitigating material 56 according to another embodiment of the present invention. The embodiment of FIG. 9 features a semiconductive substrate 58 with conductive areas 60 placed thereon. According to one embodiment, the sheet resistance of the semiconductive substrate 58 may be selected from a range of from about 1 kΩ/sq. to about 20 kΩ/sq. Similarly to the other embodiments described herein, the conductive areas 60 may be provided in a variety of sizes and shapes.

Figure 10:
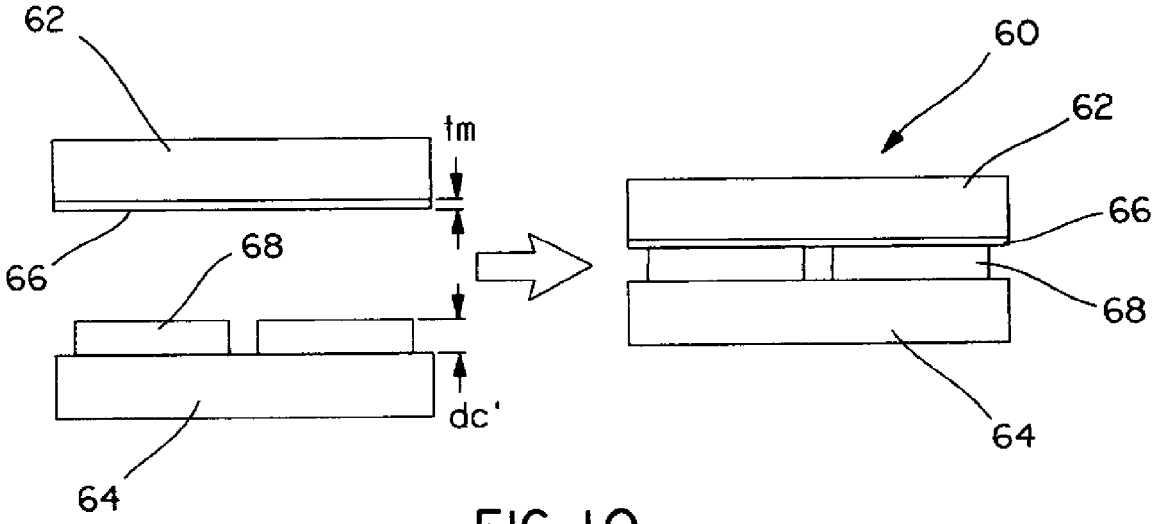
FIG. 10 is an illustration showing the assembly of a crosstalk-mitigating material according to one embodiment of the present invention.

FIG. 10 shows a process for manufacturing an alternative crosstalk-mitigating material 60. The crosstalk-mitigating material 60 comprises first and second outer substrate layers 62 and 64, a thin metal layer 66, and conductive areas 68. The depth of the conductive areas is shown as $d_c'$. Before assembly of the crosstalk-mitigating material 60, the thin metal layer 66 is on the first outer substrate layer 62, and the conductive areas 68 are on the second outer substrate layer 64. The two sub-assemblies are combined as shown into the crosstalk-mitigating material 60.

According to different embodiments of the present invention, crosstalk-mitigating materials are used to surround: (a) an entire cable core; (b) each of the twisted pairs within the cable; or (c) a subset of twisted pairs within the cable. According to some embodiments of the present invention, crosstalk-mitigating material surrounds both the entire cable core and either each of the twisted pairs within the cable, or a subset of twisted pairs within the cable.

While particular embodiments and applications of the present invention have been illustrated and described, it is to be understood that the invention is not limited to the precise construction and compositions disclosed herein, and that various modifications, changes, and variations may be apparent from the foregoing descriptions without departing from the spirit and scope of the invention.

The invention claimed is:

1. A communications cable comprising:

a plurality of twisted pairs of conductors; and crosstalk-mitigating material surrounding said plurality of twisted pairs of conductors, said crosstalk-mitigating material comprising a substrate, a continuous thin metal layer, and a plurality of discontinuous conductive areas overlaid on said continuous thin metal layer, said conductive areas being separated from one another by gaps, said continuous thin metal layer being thinner than said conductive areas;

wherein said plurality of said conductive areas are separated from one another by said gaps in a circumferential direction of said communications cable, and wherein each of said plurality of conductive areas is discontinuous.

2. The communications cable of claim 1, wherein said conductive areas are rectangular.

3. The communications cable of claim 2 wherein said conductive areas are rectangles having dimensions of approximately 0.2 inches by approximately 0.3 inches.

4. The communications cable of claim 3 wherein said conductive areas are separated from one another by said gaps having a width of approximately 0.005 inches.

5. The communications cable of claim 2 wherein said conductive areas have rounded corners.

6. The communications cable of claim 1 wherein said conductive areas are hexagonal.

7. The communications cable of claim 1 wherein said conductive areas have a thickness between approximately 0.2 μm and approximately 0.8 μm.

8. The communications cable of claim 1 further comprising a protective covering protecting said conductive areas.

9. The communications cable of claim 1 wherein said substrate is a dielectric material.

10. The communications cable of claim 1 wherein said substrate is semiconductive.

11. The communications cable of claim 1 further comprising additional crosstalk-mitigating material surrounding each of said twisted pairs of conductors, said additional crosstalk-mitigating material comprising an additional substrate and additional conductive areas placed thereon.

12. The communications cable of claim 1 further comprising additional crosstalk-mitigating material surrounding a subset of said twisted pairs of conductors, said additional crosstalk-mitigating material comprising an additional substrate and additional conductive areas placed thereon.

13. A communications cable comprising:

a plurality of twisted pairs of conductors; and crosstalk-mitigating materials surrounding each of said plurality of twisted pairs of conductors, each of said crosstalk-mitigating materials comprising a substrate, a continuous thin metal layer, and a plurality of discontinuous conductive areas overlaid on said continuous thin metal layer, said conductive areas being separated from one another by gaps, said continuous thin metal layer being thinner than said conductive areas;

wherein said plurality of said conductive areas are intermittently disposed around said twisted pairs of conductors, and wherein each of said plurality of conductive areas is discontinuous.

14. The communications cable of claim 13, wherein said conductive areas are rectangular.

15. The communications cable of claim 14 wherein said conductive areas have rounded corners.

16. The communications cable of claim 13 wherein said conductive areas are hexagonal.

17. The communications cable of claim 13 wherein said conductive areas have a thickness between approximately 0.2 μm and approximately 0.8 μm.

18. The communications cable of claim 13 further comprising protective coverings protecting said conductive areas.

19. The communications cable of claim 13 wherein said substrate is a dielectric material.

20. The communications cable of claim 13 wherein said substrate is semiconductive.

21. A communications cable comprising:

a plurality of twisted pairs of conductors; and crosstalk-mitigating material surrounding said plurality of twisted pairs of conductors, said crosstalk-mitigating material comprising a substrate and a plurality of discontinuous conductive areas overlaid on said substrate, said conductive areas being separated from one another by gaps;

wherein said conductive areas are separated from one another by said gaps in a circumferential direction of said communications cable, wherein said conductive areas have a thickness between approximately 0.2 μm and approximately 0.8 μm, and wherein each of said plurality of conductive areas is discontinuous.

* * * * *